US007459104B2

(12) United States Patent
Olding et al.

(10) Patent No.: US 7,459,104 B2
(45) Date of Patent: Dec. 2, 2008

(54) LOW TEMPERATURE FIRED, LEAD-FREE THICK FILM HEATING ELEMENT

(75) Inventors: Timothy Russell Olding, Kingston (CA); David Andrew Barrow, Milton (CA); Mary Ann Ruggiero, Toronto (CA)

(73) Assignee: Datec Coating Corporation, Mississauga (CA)

( * ) Notice: Subject to any disclaimer, the term of this patent is extended or adjusted under 35 U.S.C. 154(b) by 0 days.

(21) Appl. No.: 11/488,173

(22) Filed: Jul. 18, 2006

(65) Prior Publication Data

US 2007/0023738 A1 Feb. 1, 2007

Related U.S. Application Data

(60) Provisional application No. 60/700,028, filed on Jul. 18, 2005.

(51) Int. Cl.
*H01B 1/00* (2006.01)

(52) U.S. Cl. ..... 252/500; 219/543; 219/466.1; 423/625; 427/314; 428/209; 252/510; 252/514

(58) Field of Classification Search ..... 252/514, 252/500, 511; 423/625; 246/76; 219/543, 219/466.1; 427/387, 314; 428/561, 209
See application file for complete search history.

(56) References Cited

U.S. PATENT DOCUMENTS

| | | | | | |
|---|---|---|---|---|---|
| 3,382,099 | A * | 5/1968 | Montmory | 438/492 |
| 3,503,030 | A * | 3/1970 | Taro et al. | 338/23 |
| 3,637,530 | A * | 1/1972 | Casale et al. | 252/520.3 |
| 3,705,993 | A * | 12/1972 | Grigorovici et al. | 338/2 |
| 4,614,673 | A * | 9/1986 | Bendig | 427/376.2 |
| 4,921,731 | A * | 5/1990 | Clark et al. | 427/314 |
| 4,961,078 | A * | 10/1990 | Takeuchi et al. | 347/199 |
| 5,093,036 | A * | 3/1992 | Shafe et al. | 252/511 |
| 5,491,118 | A * | 2/1996 | Hormadaly | 501/20 |
| 5,508,495 | A * | 4/1996 | Yahav et al. | 219/466.1 |
| 5,822,675 | A * | 10/1998 | Paquet et al. | 428/561 |
| 5,879,788 | A | 3/1999 | Fukuta et al. | |
| 6,736,997 | B2 | 5/2004 | Olding et al. | |
| 7,049,558 | B2 * | 5/2006 | Baer et al. | 219/548 |
| 2002/0195444 | A1 * | 12/2002 | Lin et al. | 219/543 |
| 2004/0258611 | A1 * | 12/2004 | Barrow et al. | 423/625 |
| 2005/0084254 | A1 * | 4/2005 | Cooper et al. | 392/379 |

* cited by examiner

*Primary Examiner*—Mark Kopec
*Assistant Examiner*—Khanh Tuan Nguyen
(74) *Attorney, Agent, or Firm*—Hill & Schumacher; Lynn Schumacher

(57) ABSTRACT

A lead free, thick film heating element. Known thick film heating elements contain environmentally hazardous material such as lead. This is particularly problematic when manufacturing thick film heating elements, as lead is often used in thick film formulations to allow the glass-based thick film to be processed at low firing temperatures. Using composite sol gel technology, the present invention provides a method to produce a lightweight mica-based thick film heating element based on thick film materials that are free from lead or cadmium. This mica-based element is lightweight, has the performance advantages of a thick film heating element, and may be processed at a low temperature using thick film materials. Particularly, the present invention provides a lightweight heating element comprised of a mica-based substrate material, a resistive thick film that can be produced by composite sol gel technology, optionally a conductive thick film which is used to make electrical connection to the resistive element, and optionally a topcoat which is used to provide protection against moisture and oxidation. This element is lightweight, provides efficient, rapid heat up and cool down, can be designed to provide even temperature distribution, and delivers power at lower operating temperatures resulting in increased element safety.

18 Claims, 2 Drawing Sheets

Heater Element with Optional Top Coat

LOW TEMPERATURE FIRED, LEAD-FREE THICK FILM HEATING ELEMENT

CROSS REFERENCE TO RELATED U.S PATENT APPLICATION

This patent application relates to U.S. utility patent application Ser. No. 60/700,028 filed on Jul. 18, 2005 entitled LOW TEMPERATURE FIRED-LEAD FREE THICK FILM HEATING ELEMENT, filed in English, which is incorporated herein in its entirety by reference.

FIELD OF THE INVENTION

The present invention relates to a low temperature fired-lead free thick film heating element and a method for producing same using composite sol gel synthesis methods.

BACKGROUND OF THE INVENTION

Thick film heating elements have been long sought after because of their ability to provide versatile designs, high power densities, uniform heat and rapid heating and cooling. These types of element designs are very efficient for direct heating either by placing the thick film element in contact with the component being heated or when they are required to radiate directed heat to the surroundings.

A mica-based thick film heating element has a resistive thick film deposited on the mica-based substrate. Mica-based substrates typically consist of mica paper or mica board that is composed of mica flakes pressed and bonded with a binder material such as a resin. A voltage is applied to the resistive thick film either via conductive tracks or directly to the resistive thick film. This is a very desirable element design because it is lightweight, provides rapid heat up and cool down times, provides very uniform heat, and delivers power at low temperatures resulting in safer element operation. As stated, it is also necessary that the film formulations used to produce this element be lead free in order to comply with the RoHS Directive being adopted by Europe in 2006.

Traditional thick film inks are not suitable for producing these lead free mica-based thick film elements. Glass based products produced by companies such as DuPont, Ferro and ESL use a combination of glass binder and a conductive or resistive component. Various combinations of metal oxides in the thick film glass frit lower the melting temperature of the glass so that it flows and produces a continuous glass matrix containing the conductive and resistive material at suitable firing temperatures. Typical thick film glass frits are designed to fire at temperatures in excess of 800° C. This is too high a processing temperature for the mica-based substrate to handle, which can typically withstand short firing times at a maximum temperature of 600° C. Melting temperatures below 600° C. can be achieved through the addition of lead to the thick film frits. However, lead is a hazardous material that many of the regulatory bodies are requiring to be removed or replaced in the future.

Polymer resistive formulations are available that may be compatible with mica-based substrate materials. However, these polymer formulations can only operate at low temperatures and are often not able to provide the wide range of power required for consumer and industrial heating element applications.

Therefore it would be very advantageous to provide a low temperature fired-lead free thick film heating element and a method for producing same.

SUMMARY OF THE INVENTION

Composite sol gel resistive and conductive thick film formulations are disclosed herein that do not contain lead or any other hazardous substances. These formulations may be deposited and fired to form the thick film components at a temperature well below 600° C. These thick film formulations can be deposited on mica-based substrate materials without degrading the quality of the mica-based substrate, and are henceforth the basis of the present invention.

Particularly, the present invention provides a lightweight heating element comprised of a mica-based substrate material, a resistive thick film that can be produced by composite sol gel technology, optionally a conductive thick film which is used to make electrical connection to the resistive element, and optionally a topcoat which is used to provide protection against moisture and oxidation. This element is lightweight, provides efficient, rapid heat up and cool down, can be designed to provide even temperature distribution, and delivers power at lower operating temperatures resulting in increased element safety. This element is very cost effective and able to provide a competitive solution in a wide range of applications. These include but are not limited to space heaters, room heaters, refrigerator defrosters, food warmers and oil warmers.

All components used to produce this element are lead free and are processed at temperatures below 600° C., and preferably below 525° C. The composite sol gel conductive and resistive formulations, unlike the glass based conductive materials, do not require the addition of lead or any other hazardous material to process them below 600° C. A composite sol gel resistive thick film is deposited on the mica-based substrate and processed below 600° C. to form a thick film heating element. Voltage can be applied directly to this resistor or through a conductive track that connects to the resistive thick film and is also deposited onto the mica at a temperature below 600° C. If necessary, a topcoat layer can be deposited onto the resistor to provide oxidation protection, moisture resistance and electrical insulation.

Thus, in one aspect of the invention there is provided a lead-free mica-based thick film heating element, comprising:

a) a mica-based substrate;

b) a ceramic lead-free resistive thick film on said mica-based substrate which is deposited using a lead-free resistive thick film formulation onto the mica-based substrate, the lead-free resistive thick film being a sol gel composite formulation based resistive thick film formulation and processed at a temperature selected to convert the sol gel into a ceramic lead-free resistive thick film; and c) a lead-free conductive thick film track deposited on top of the lead free resistive thick film, or between the mica-based substrate and the lead-free resistive thick film, using a lead free conductive thick film formulation and processed at a temperature to provide a conductive track connected to the lead free resistive thick film.

The present invention also provides a lead-free mica-based thick film heating element produced by the steps comprising:

coating a mica-based substrate with a lead-free resistive thick film on said mica-based substrate which is deposited using a lead-free resistive thick film formulation, and processing the a lead-free resistive thick film formulation at a temperature between about 200° C. and about 600° C.

A further understanding of the functional and advantageous aspects of the invention can be realized by reference to the following detailed description and drawings.

BRIEF DESCRIPTION OF THE DRAWINGS

The invention will be more fully understood from the following detailed description thereof taken in connection with the accompanying drawings, which form a part of this application, and in which.

DETAILED DESCRIPTION OF THE INVENTION

Figure 1:
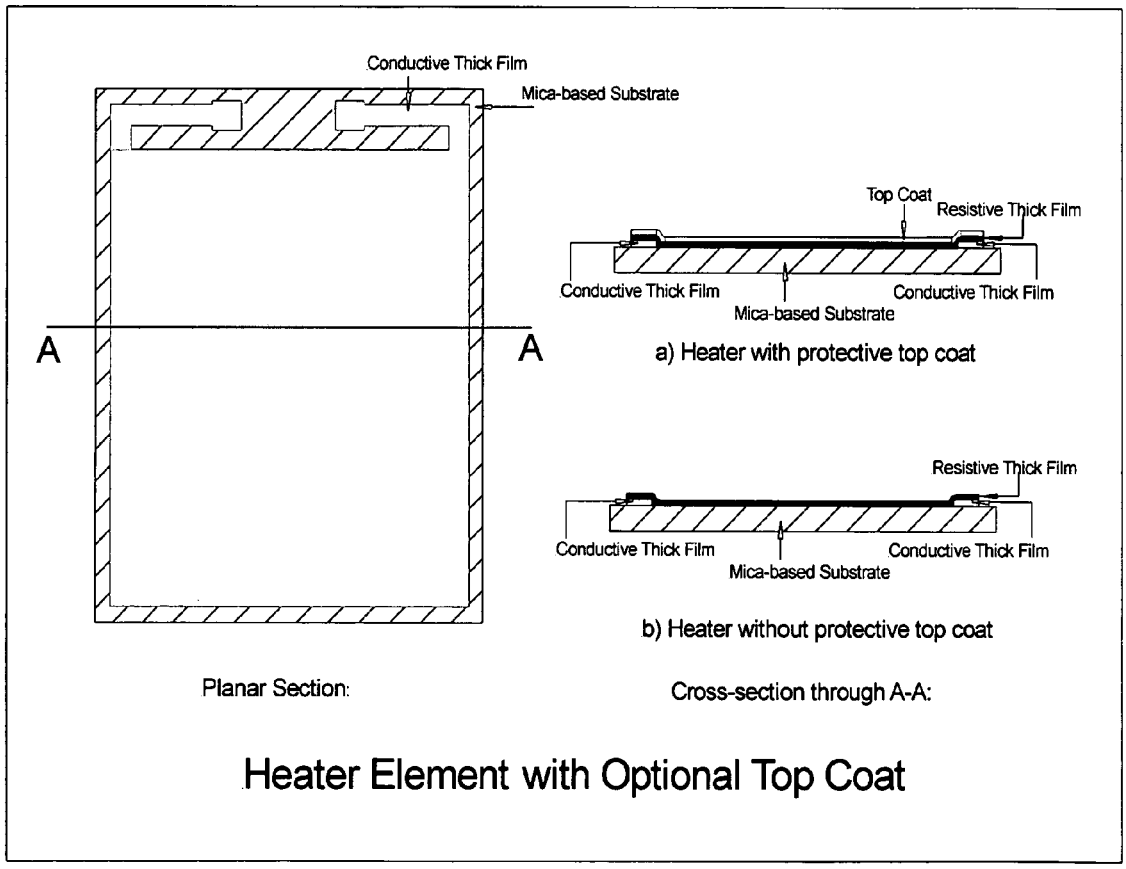
FIG. 1 illustrates an embodiment of a lead-free thick film heating element.

As used herein, the phrase "thick film" means a film with a thickness in the range of from about 1 to about 1000 um with a preferred thickness of 10-100 um (for the examples given).

An embodiment of this invention includes a mica-based substrate, which is lead (and cadmium) free and may withstand temperatures up to 600° C. The surface of this mica-based substrate may be treated to provide a uniform layer for deposition. Examples of the surface treatment include sanding, rubbing and sandblasting.

A lead-free composite sol gel resistive thick film element is deposited onto the mica-based substrate and processed to a temperature below 600° C., typically to 450-500° C. to cure the coating. The composite sol gel resistive thick film may be made according to copending United States Patent Publication 20020145134, (U.S. patent application Ser. No. 10/093,942 filed Mar. 8, 2002) to Olding et al. (which is incorporated herein in its entirety by reference) and the resistive powder can be one of graphite, silver, nickel, doped tin oxide or any other suitable resistive material, as described in the Olding patent publication. The sol gel formulation is a solution containing reactive metal organic or metal salt sol gel precursors that are thermally processed to form a ceramic material such as alumina, silica, zirconia, titania or combinations thereof. U.S. Patent Publication No. 20040258611 based on U.S. patent application Ser. No. 10/601,364 entitled: Colloidal composite sol gel formulation with an expanded gel network for making thick inorganic coatings also describes the sol gel process as it relates to the present invention and it is incorporated herein in its entirety by reference.

The sol gel process involves the preparation of a stable liquid solution or "sol" containing inorganic metal salts or metal organic compounds such as metal alkoxides. The sol is then deposited on a substrate material and undergoes a transition to form a solid gel phase with further drying and firing at elevated temperatures, whereby the "gel" is converted into a ceramic coating.

A lead-free conductive thick film can be used to make an electrical connection to the resistive thick film element. This conductive thick film is deposited either before or after deposition of the resistive coating. It can be processed using a separate processing step to below 600° C. or alternatively it can be co-fired with the resistive layer. The lead-free conductive thick film can be made from a composite sol gel formulation that contains nickel, silver or any other suitable conductive powder or flake material. The sol gel formulation may be prepared from but not limited to alumina, silica, zirconia, or titania metal organic precursors stabilized in solution.

The thick conductive film is a track for electrical contact and may cover the entire surface (on the mica directly or on top of the resistive layer) or it may be deposited in large areas or in a track pattern.

Alternately, the conductive thick film may be produced from any commercially available thick film product that is lead-free. One suitable thick film product is Parmod™ VLT from Parelec, Inc. which contains a reactive silver metal organic, and silver flake or powder dispersed in a vehicle and can be fired at a temperature typically between 200 to 300° C. Since the conductive film may not be exposed to the heating temperatures in the resistive thick film, some high temperature polyimide or polyamide-imide based silver thick film products may also be suitable for use in producing the conductive thick film.

A topcoat containing ceramic, glass or high temperature polymer (fluoropolymers such as PTFE, siloxanes, silicones, polyimides, etc.) can be deposited onto the resistive and conductive thick films to provide oxidation protection and/or to ensure that the element is not affected by water. FIG. 1 illustrates the heater element and the different optional coatings.

Connectors and/or wires can be attached to the conductive track or to the resistive track if the conductive thick film track is not used. The heating element is activated by applying a voltage to the connectors and/or wires and the resistance of the resistive layer generates heat based on the current flow across the resistor ($P=I^2R$). If the connectors and/or wires are not used, the voltage can be applied directly to the conductive or resistive track.

The present invention will now be illustrated by the following non-limiting examples.

EXAMPLE 1

Figure 2:
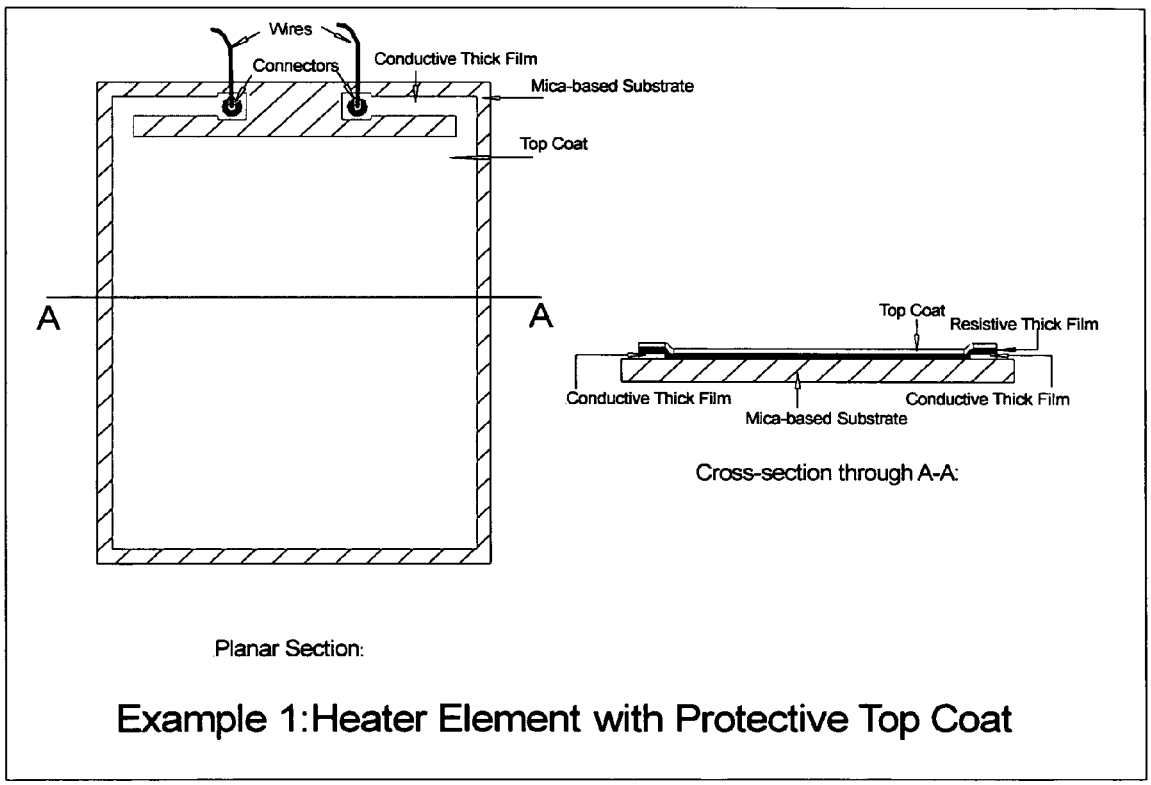
FIG. 2 illustrates another embodiment of a lead-free thick film heating element.

A mica-based thick film heating element is made by depositing and processing a conductive thick film track to 450° C. using a lead free silver thick film formulation comprised of silver flake dispersed in a silica-based sol gel solution which is processed to 450° C. A lead-free resistive thick film is deposited and processed to 450° C. using a resistive thick film formulation comprised of graphite powder dispersed in an alumina-based sol gel solution The resistive thick film is deposited onto the mica-based substrate so that it makes contact with the conductive thick film track to form the thick film heating element. FIG. 2 shows the different layers on the mica substrate.

A topcoat formulation containing polytetrafluoroethylene (PTFE) powder is deposited onto the heating element to provide oxidation resistance and moisture protection. This topcoat is processed to 450° C. Wire connectors are then attached to the thick film heating element. When a voltage V is applied to the element it heats up according to the input power $P=V^2/R$, where R is the resistance of the thick film heating element.

EXAMPLE 2

A mica-based thick film heating element is made according to example 1, but the conductive thick film track is deposited and processed to 450° C. using Parmod VLT, a commercially available thick film silver ink that is lead-free, but not sol gel composite-based as in Example 1.

EXAMPLE 3

A mica-based thick film heating element is made according to Example 1, but the conductive thick film track is deposited and processed to 350° C. using a silver thick film formulation comprised of silver flakes dispersed in a polyamide-imide polymeric binder solution that is lead-free, but not sol gel composite-based as in Example 1.

EXAMPLE 4

A mica-based thick film heating element is made according to example 1, but the resistive thick film is deposited first followed by the conductive thick film.

EXAMPLE 5

A mica-based thick film heating element is made according to example 1, but both the conductive thick film track and the resistive thick film were deposited before processing to 450° C.

EXAMPLE 6

A mica-based thick film heating element is made by depositing a resistive thick film track using a lead-free silver thick film comprised of silver flake dispersed in a silica-based sol gel solution. The length and width of the silver track are set to give the required resistance. The resistive track is then processed to 450° C. A topcoat formulation containing polytetrafluoroethylene (PTFE) powder is deposited onto the heating element to provide moisture protection. This topcoat is processed to 450° C. Wire connectors are attached to the element.

As used herein, the terms "comprises", "comprising", "including" and "includes" are to be construed as being inclusive and open ended, and not exclusive. Specifically, when used in this specification including claims, the terms "comprises" and "comprising" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A lead-free mica-based thick film heating element, comprising:

a) a mica-based substrate;

b) a ceramic lead-free resistive thick film on said mica-based substrate which is deposited using a lead-free resistive thick film formulation onto the mica-based substrate, the lead-free resistive thick film being a sol gel composite formulation based resistive thick film formulation and processed at a temperature selected to convert the sol gel into a ceramic lead-free resistive thick film; and c) a lead-free conductive thick film track deposited on top of the lead free resistive thick film, or between the mica-based substrate and the lead-free resistive thick film, using a lead free conductive thick film formulation and processed at a temperature to provide a conductive track connected to the lead free resistive thick film.

2. The heating element according to claim 1 wherein the lead free resistive thick film is processed at a temperature between about 200° C. and about 600° C. and the lead-free conductive thick film track is processed at a temperature between about 200° C. and about 600° C.

3. The heating element according to claim 2 wherein the sol gel composite formulation includes any one or combination of alumina, silica, zirconia and titania sol gel precursors in solution.

4. The heating element according to claim 2 wherein the sol gel composite formulation is processed at a temperature between about 350° C. and about 450° C.

5. The heating element according to claim 1 wherein the lead free resistive thick film formulation includes graphite powder or flake dispersed in a sol gel solution.

6. The heating element according to claim 1 wherein the lead free resistive thick film formulation includes silver powder or flake dispersed in a sol gel solution.

7. The heating element according to claim 1 wherein the lead free resistive thick film formulation includes a silver powder or flake and a reactive silver product with binding properties.

8. The heating element according to claim 7 wherein the reactive silver product with binding properties includes a metal organic silver precursor dispersed in solution.

9. The heating element according to claim 1 wherein the lead free conductive thick film formulation is a sol gel composite based conductive thick film formulation.

10. The heating element according to claim 1 wherein the lead free conductive thick film formulation includes silver powder or flake dispersed in a sol gel solution.

11. The heating element according to claim 1 wherein the lead free conductive thick film formulation includes silver powder or flake and a reactive silver product with binding properties.

12. The heating element according to claim 11 wherein the reactive silver product with binding properties includes a metal organic silver precursor dispersed in solution.

13. The heating element according to claim 1 wherein the lead-free conductive thick film formulation includes silver powder or flake and a polymer with binding properties dispersed in solution.

14. The heating element according to claim 13 wherein the polymer with binding properties is selected from the group consisting of high temperature polyimides or polyamide-imides.

15. The heating element according to claim 1 including a topcoat deposited on the heating element to provide oxidation and/or moisture protection.

16. The heating element according to claim 15 wherein the top coat contains a fluoropolymer.

17. The heating element according to claim 16 wherein the fluoropolymer is selected from the group consisting of PTFE, siloxanes, silicones, polyimides and combinations thereof.

18. The heating element according to claim 1 wherein said lead-free resistive thick film has a thickness in a range from about 1 micron to about 1000 microns.

* * * * *